United States Patent [19]

Moberg

[11] 4,353,583

[45] Oct. 12, 1982

[54] SEAL OF THE PADLOCK TYPE

[75] Inventor: Sigurd M. Moberg, Etlan, Va.

[73] Assignee: E. J. Brooks Company, Newark, N.J.

[21] Appl. No.: 144,871

[22] Filed: Apr. 29, 1980

Related U.S. Application Data

[63] Continuation of Ser. No. 661,829, Feb. 26, 1976, abandoned.

[51] Int. Cl.[3] ..... B65D 33/34

[52] U.S. Cl. ..... 292/320

[58] Field of Search ..... 292/307-316; 339/276 T

[56] References Cited

U.S. PATENT DOCUMENTS

| | | | |
|---|---|---|---|
| 367,877 | 8/1887 | Whaley et al. | 292/320 |
| 599,066 | 2/1898 | Schofield | 292/308 |
| 782,435 | 2/1905 | Brooks | 292/308 |
| 942,435 | 12/1909 | Brooks | 292/308 |
| 1,125,915 | 1/1915 | Platt | 292/310 |
| 1,751,839 | 3/1930 | Moskowits | 292/308 |
| 1,964,014 | 6/1934 | Wenk | 292/320 |
| 2,006,042 | 6/1935 | Dietye | 292/308 X |
| 2,721,986 | 10/1955 | Badeau | 339/276 T |
| 3,485,521 | 12/1969 | Moberg | 292/320 |

*Primary Examiner*—Richard E. Moore

*Attorney, Agent, or Firm*—Robert E. Ross

[57] ABSTRACT

A seal of the padlock type which has a plastic body with a pair of spaced cavities, and a U-shaped shackle having ends non-removably engaged in the cavities in which the ends in the cavities each have reversely bent portions, forming a bight, and the plastic body is deformed inwardly into the cavity between each of the end portions and the cavity entrance to prevent extraction of the end portions from the openings and to provide a visual indication that the seal has been properly closed.

3 Claims, 10 Drawing Figures

SEAL OF THE PADLOCK TYPE

This application is a continuation of my application Ser. No. 661,829, filed Feb. 26, 1976, now abandoned.

BACKGROUND OF THE INVENTION

In U.S. Pat. No. 3,485,521 there is illustrated a seal comprising a seal body of plastic material, said body having a pair of cavities, and a U-shaped wire shackle, each leg of which is provided with a reversely bent end for insertion into a body cavity, so that the shackle cannot be disengaged from the body without evidence of such attempt at pilferage being visible, such as rupture of the shackle or protrusion of one of the shackle ends from the surface of the body.

Although such devices are widely used and have been found generally satisfactory in providing a reliable seal, it has been found that in rare instances a leg of the wire shackle can be removed from the seal body without leaving evidence of tampering that is readily noticeable. Also, it is difficult for an inspector to detect, by visual examination, that the seal is properly closed, and the effectiveness of the closure can be assured only by applying a tensile force to the seal, which testing force itself might cause rupture of the seal.

SUMMARY OF THE INVENTION

The object of this invention is to provide a seal of the above-described type which has seal body portions deformed into the exit path of the reverse bent end portion, said deformation being accomplished after the seal has been closed. In the illustrated embodiment of the invention the deformations are provided by a hand-operated tool which has a pair of jaws for receiving the seal, one jaw being in the form of a flat platen on which the seal body is placed, the other jaw having a pair of projections positioned to enter the seal body at a position between the bight of the reversely bent shackle ends and the cavity entrance. The projections, in entering the seal body, provide obstructions to the removal of the shackle legs to render it impossible to remove a leg from the seal body without leaving obvious evidence of tampering, and provides a visual indication that the seal has been properly closed. If desired, a number, initials, or other indicia may be provided on the tool to emboss the seal body to provide identification of the person applying the seal.

DESCRIPTION OF THE ILLUSTRATED EMBODIMENT

Figure 1:
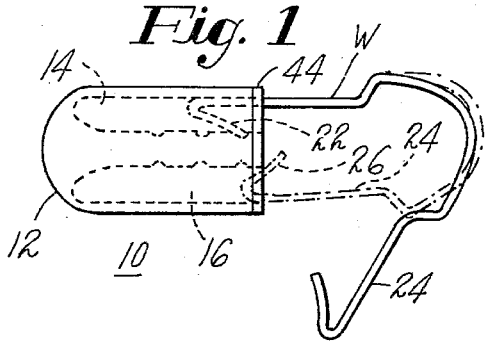
FIG. 1 is a plan view of a seal of the type for use in the seal assembly of the invention.

Referring to FIG. 1, there is illustrated a seal 10 comprising a plastic body 12 having cavities 14 and 16, and a preformed wire shackle 18, having a leg 20 with reversely bent end 22 assembled into the body cavity 14 and a shorter leg 24, having a reversely bent end portion 26 originally positioned free of the body.

Figure 2:
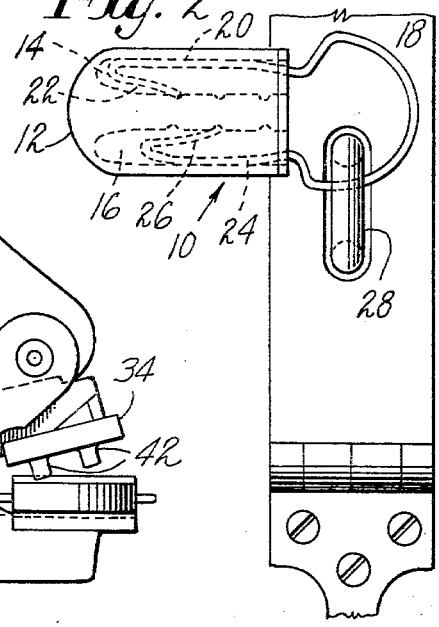
FIG. 2 is a view of the seal assembled onto a closure fastener with the seal being shown in plan view, prior to the deformation of the seal body.
Figure 3:
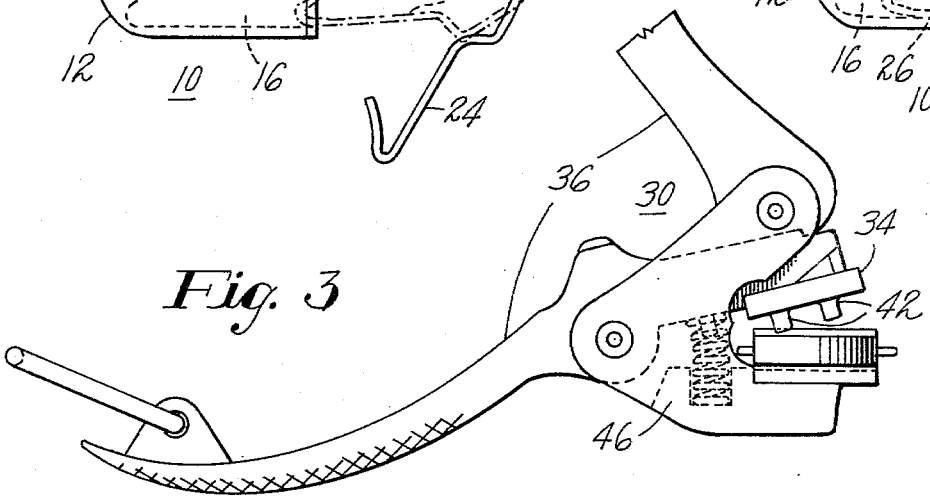
FIG. 3 is a view in side elevation of a seal deforming tool with the seal in the condition shown in FIG. 2, in position for deforming.

As described in the above-mentioned U.S. Pat. No. 3,485,521, the seal is assembled by inserting the free leg 24 through the staple 28 of a closure fastener, and then inserting the end of leg 24 into the body cavity 16. Both legs 20 and 24 are then pushed further into the cavities until the ends thereof seat in pre-formed notches in the aperture wall (see FIG. 2).

Thereafter the seal body 12 is deformed by a suitable tool such as a manually operated plier-like tool 30, which comprises a pair of jaws 32 and 34 operated by handles 36. The jaw 32 is in the form of a flat platen having a pair of shallow recesses 40 in the surface thereof, and the jaw 34 has a pair of projections 42 which are positioned to be aligned with the recesses 40 when the jaws are closed.

Figure 4:
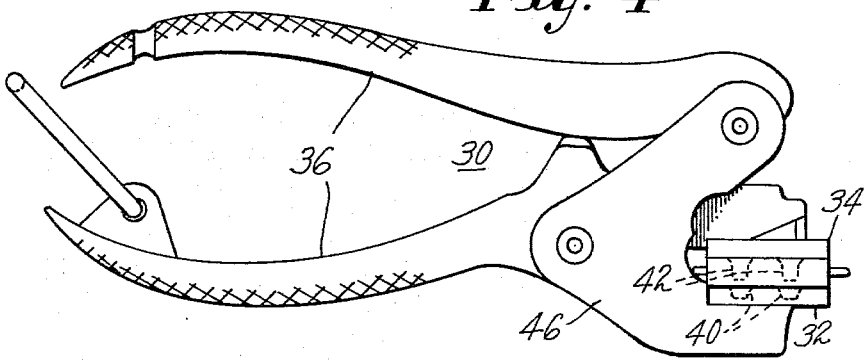
FIG. 4 is a view of the jaw and seal illustrated in FIG. 3, in which the tool has been operated to deform the seal.
Figure 5:
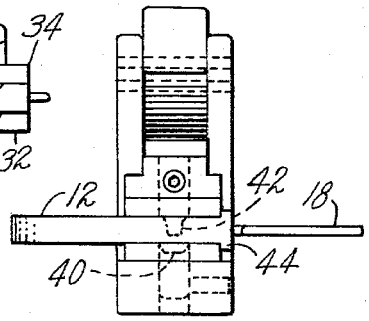
FIG. 5 is a view of the seal and tool as illustrated in FIG. 4 as seen from the right side.
Figure 7:
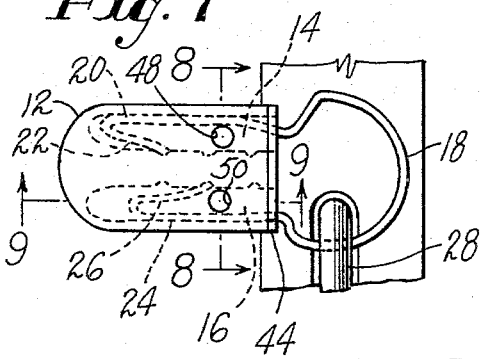
FIG. 7 is a top plan view of the seal after completion of the deformation by the tool.
Figure 6:
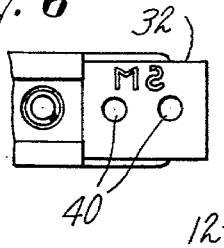
FIG. 6 is a top plan view of the lower jaw of the tool.
Figure 8:
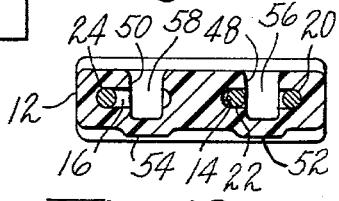
FIG. 8 is a view taken on line 8—8 of FIG. 7.
Figure 9:
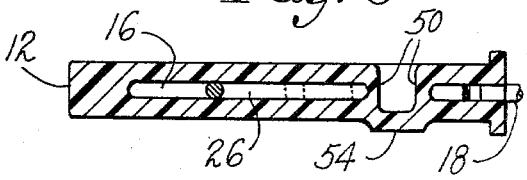
FIG. 9 is a view taken on line 9—9 of FIG. 7.
Figure 10:
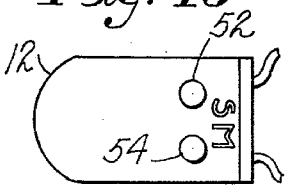
FIG. 10 is a view of the seal as illustrated in FIG. 6 as seen from the opposite side.

As illustrated in FIG. 4, in the closed position, the jaws do not contact each other, but are spaced apart a distance such that the ends of the projections do not extend to the plane of the platen, for a purpose to appear hereinafter.

The desired deformation of the seal is accomplished by placing the seal between the jaws of the tool so that a flange 44 at the top edge of the seal body rests against the side edge of the platen and the rear edge of the body rests against the frame 46 of the tool. The seal body is thereby so positioned that the recesses 40 are disposed below the cavities 14 and 16 between the ends of the legs 20 and 24 and the aperture openings at the top of the seal body. The jaws are then closed as far as possible so that the projections 42 enter the seal body.

The ends of the projections 42 are not provided with a sharp cutting edge, but are sufficiently rounded that in entering the seal, the portions of the side wall of the seal body encountered by the projections are not cut but are drawn downwardly into the cavities 14 and 16 to form walls 48 and 50 respectively that extend across the cavities between the reverse bent end of the shackle legs and the entrance to the cavity.

The jaw projections 42, at the end of the jaw closing movement, also emboss the lower side wall of the seal into the recesses 40 in the lower jaw to form a pair of projections 52 and 54 protruding from the seal body surface.

The resulting structure effectively prevents the shackle legs from being pulled out of their respective openings, since if a reverse bent end of a shackle leg fails to engage in a notch in the side wall of the aperture in which it is inserted, efforts to pull the leg out of the opening will cause the bight of the leg to catch on the wall (48 or 50) extending across the opening.

Recesses 56 and 58 formed by the tool on one side and the projections 52 and 54 on the other side provide readily observed visual indication that the seal has been properly applied and that the tool has been applied to the seal.

In some types of plastic (such as polypropylene) containing coloring material, the deformation applied to the plastic causes it to become a considerably lighter color than the un-deformed plastic. Hence the projections 52 and 58 will be almost white, in contrast to the surrounding material, and hence will be readily visible.

If desired either upper or lower jaw may be provided with raised indicia, such as numbers or letters 60, which will be embossed into the surface of the seal body, and serve to identify the person who applied the seal.

The fact that the shackle 18 has legs of unequal length makes it impossible to apply the tool to the seal body so as to produce the projections 52 and 54 unless both legs are fully entered into the cavities. For example, if the tool is applied to the seal in the condition of FIG. 1, the end of the leg 20 in the cavity 14 will interfere with the operation of the tool. If the legs are inserted further into the cavities so that the end 26 of the leg 24 is just barely inside the cavity (where it could be easily removed and re-inserted), the end 26 will be in the path of a projection 42 of the tool. Although the seal could be placed in the tool so that the indentations are made further away from the end of the seal having the cavity entrances, a seal with the indentations and projections out of the ordinary position would be readily noticed by an inspector.

Although in the illustrated embodiment of the invention, two cavities are provided, each receiving a shackle leg with reverse bent end portions, it will be understood that a seal with one cavity only could be provided to receive one leg of the shackle, with the other leg being secured to the seal in some other manner.

Although the illustrated shackle of the invention utilizes a shackle with legs having ends that are bent back on themselves to provide an extreme end that can frictionally engage the surface of the cavity to prevent withdrawal and to provide a bight to engage the obstruction formed by the tool in case the extreme end does not securely engage the cavity wall, it will be understood that in some cases the leg may be provided with other configurations that will prevent the end of the leg from being pulled past the obstruction, such as a zig-zag form or a right angle bend on the extreme end.

Since certain changes obvious to one skilled in the art can be made in the specific embodiment of the invention illustrated herein, it is intended that all matter contained herein be construed in an illustrative and not a limiting sense.

I claim:

1. A padlock-type seal, comprising a housing having a cavity opening to the exterior of the housing and a U-shaped wire shackle, said shackle having a pair of legs, one leg being attached to the seal housing, the other leg being disposed in the cavity and having a reverse bend near the end thereof forming a bight which is flexed together by the cavity walls, and a straight walled obstruction extending through the cavity, said obstruction being smaller in plan area than the cavity and being positioned to be in the path of the bight if attempts are made to pull the leg out of the cavity, said obstruction being formed by deforming a wall portion of the cavity inwardly through the cavity to form a surface indentation on one side of the seal and causing a wall portion on the opposite side of the seal to provide visual indication of sealing.

2. A padlock-type seal, comprising a housing having a pair of cavities opening to the exterior of the housing, a U-shaped wire shackle having a pair of legs, each leg having a bent end portion disposed in one of the cavities and being flexed toward the adjacent leg portion by the cavity walls, and a pair of discrete indentations formed in the sidewall of the seal body, each indentation being formed by forcing a discrete portion of the wall material inwardly without shearing through a cavity at a position between the bent end and the cavity opening, said indentations forming an obstruction having straight walls extending through the cavity.

3. A method of increasing the security of a seal of the type having a seal body with a cavity opening to the exterior thereof and a shackle having a leg with a reverse bent end portion forming a bight disposed in the cavity, said bent end portion being maintained flexed by the cavity wall toward the adjacent portion of the leg, comprising deforming a cylindrical portion of the seal body wall over the cavity inwardly through the cavity, said obstruction being smaller in plan area than the cavity and positioned between the bight and the opening.

* * * * *